United States Patent [19]

Larsson

[11] Patent Number: 4,494,297

[45] Date of Patent: Jan. 22, 1985

[54] METHOD OF PRODUCING CASTINGS WITH MEANS TO FACILITATE BURR REMOVAL

[75] Inventor: Sten Larsson, Eskilstuna, Sweden

[73] Assignee: Asea Aktiebolag, Västerås, Sweden

[21] Appl. No.: 427,305

[22] Filed: Sep. 29, 1982

[30] Foreign Application Priority Data

Oct. 6, 1981 [SE] Sweden ..... 8105884

[51] Int. Cl.[3] ..... B22D 11/126; B22D 11/128

[52] U.S. Cl. ..... 29/527.6; 29/418; 29/DIG. 5; 29/DIG. 26; 164/69.1; 164/262; 219/69 R; 219/121 PC; 219/121 LG

[58] Field of Search ..... 29/527.6, 418, DIG. 5, 29/DIG. 26; 164/69.1, 70.1, 262, 263, 265; 219/68, 69 R, 121 PC, 121 LG; 264/161, 162, 138; 425/806 R; 409/138, 139, 140

[56] References Cited

U.S. PATENT DOCUMENTS

| | | | |
|---|---|---|---|
| 1,195,204 | 8/1916 | Gleason | 264/161 |
| 2,232,216 | 2/1941 | Daly | 264/161 X |
| 2,266,787 | 12/1941 | Morin | 164/265 |
| 2,302,367 | 11/1942 | Ericson | 164/265 |
| 2,381,807 | 8/1945 | Davis et al. | 409/140 X |
| 2,890,483 | 6/1959 | Soubier | 425/806 X |
| 2,908,936 | 10/1959 | Kilborn | 164/262 X |
| 3,417,462 | 12/1968 | McClelland | 29/527.6 X |
| 3,468,775 | 9/1969 | Lanning et al. | 219/68 X |
| 3,486,190 | 12/1969 | Walchter et al. | 264/161 X |
| 3,487,501 | 1/1970 | Siard et al. | 264/161 X |
| 3,495,650 | 2/1970 | Perrella | 164/262 |
| 3,590,428 | 7/1971 | Munk | 264/161 |
| 3,593,374 | 7/1971 | Sierd et al. | 264/161 X |
| 3,604,890 | 9/1971 | Mullaney | 219/121 LG |
| 3,772,946 | 11/1973 | Sarra | 164/70.1 X |
| 3,785,045 | 1/1974 | Reis | 29/527.6 |
| 3,846,531 | 11/1974 | Reilly | 425/806 X |
| 3,864,815 | 2/1975 | Koch | 164/70.1 X |
| 3,950,189 | 4/1976 | Lange et al. | 219/121 PC X |
| 3,952,630 | 4/1976 | Fencl | 409/140 |
| 3,989,786 | 11/1976 | Mehnert et al. | 425/806 X |
| 4,035,604 | 7/1977 | Meleka et al. | 219/68 X |
| 4,060,121 | 11/1977 | Gwaltney et al. | 164/70.1 X |
| 4,324,972 | 4/1982 | Furrer et al. | 219/121 LG X |
| 4,332,999 | 6/1982 | Wittke | 219/121 LG X |
| 4,347,957 | 9/1982 | Rögener | 164/70.1 X |
| 4,362,448 | 12/1982 | Hasebe et al. | 164/263 X |
| 4,376,603 | 3/1983 | Hudgins | 409/140 |
| 4,380,423 | 4/1983 | Aoki | 425/806 X |
| 4,419,801 | 12/1983 | Yamashita et al. | 29/527.6 X |
| 4,424,620 | 1/1984 | Oshineky | 29/558 |

FOREIGN PATENT DOCUMENTS

| | | | |
|---|---|---|---|
| 2828258 | 1/1980 | Fed. Rep. of Germany | 409/140 |
| 2949656 | 6/1981 | Fed. Rep. of Germany | 409/140 |
| 89421 | 7/1981 | Japan | 409/140 |
| 128746 | 7/1950 | Sweden . | |

*Primary Examiner*—Charlie T. Moon
*Assistant Examiner*—Ronald S. Wallace
*Attorney, Agent, or Firm*—Watson, Cole, Grindle & Watson

[57] ABSTRACT

A method is described for producing castings and removing burrs produced during the casting at the parting line of the casting mold and in regions where cores are supported in core-supporting holes formed in the mold. The casting mold is so shaped that a well-defined burr, which includes a substantially uninterrupted flange projecting from the casting, is formed in the region of the casting which solidifies opposite the mold parting line. The mold may also be so shaped that a further well-defined burr, which includes a further substantially uninterrupted flange projecting from the casting, is formed in the region of the casting which solidifies where a core of the casting mold enters a core-supporting hole. After removal of the casting from the mold, the or each flange is removed by a mechanical cutting tool or by gas cutting, preferably by employing an industrial robot to effect relative movement between the flange and the flange-removing means.

7 Claims, 7 Drawing Figures

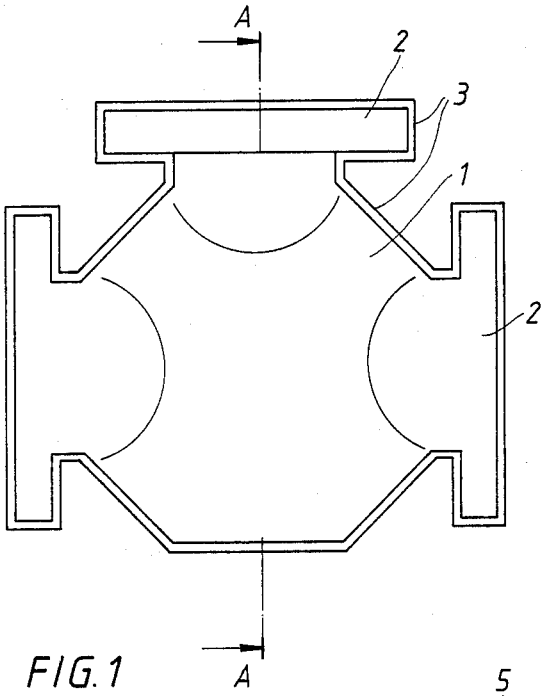
FIG. 1
FIG. 2
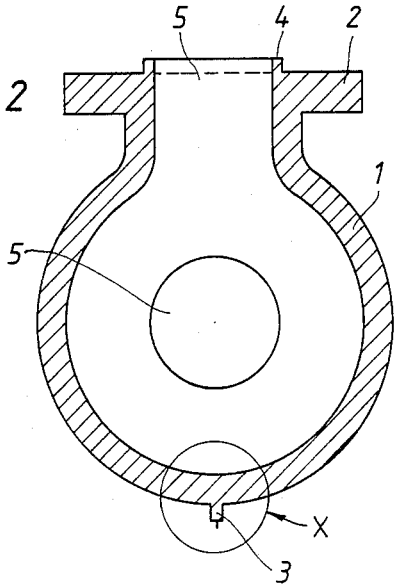
FIG. 3
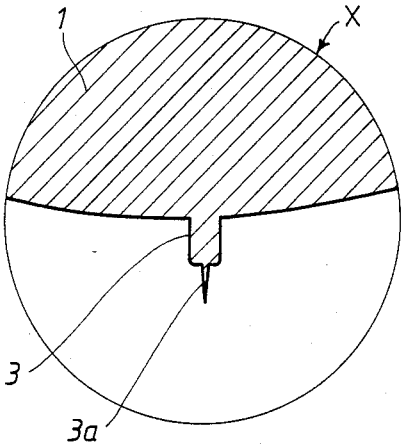

METHOD OF PRODUCING CASTINGS WITH MEANS TO FACILITATE BURR REMOVAL

TECHNICAL FIELD

This invention relates to a method of producing a casting and particularly to a method that has the result of facilitating the removal of undesired burrs from the casting.

BACKGROUND OF THE INVENTION

In the production of castings it is inevitable, due to irregularities in the assembled mold sections and irregularities in cores and core-supporting holes formed in the mold sections, that small, undesired gaps are formed within the mold. During the subsequent casting of molten material into the mold, these gaps are penetrated by the molten material and give rise to the formation of burrs on the casting at the part line of the mold sections and where cores are supported in the mold section. These burrs have to be removed in a subsequent fettling operation.

The cost of fettling castings constitutes a considerable part of the manufacturing costs incurred in a casting shop. For steel castings, the fettling costs may amount to as much as 50% of the processing costs. The removal of the casting gate and the feeder from a casting constitute laborious and the most expensive parts of the fettling work, but the removal of burrs formed at the mold parting line and around the location of cores also involves a considerable amount of costly work. The fettling work is dirty, monotonous, heavy and unpleasant from the point of view of health and the environment. It is, therefore, desirable to mechanize the fettling work to the greatest possible extent.

It has been known in the past to employ robots in foundries for certain work operations. Thus, programmable robots have been used for handling castings or tools during the cutting of casting gates and feeders and for burr removal.

The primary object of the present invention is to provide a method of producing a casting which facilitates mechanized removal of undesired burrs from the casting.

DISCLOSURE OF THE INVENTION

According to the invention, in a method of producing a casting which comprises the steps of employing a casting mold having two mold sections contacting one another along a parting line, pouring a solidifiable melt into the mold, removing the solidified casting from the mold, and removing at least one undesired burr from the casting, at least one of the mold sections being shaped in the vicinity of the parting line so that, in the region of the casting that solidifies opposite (within) the parting line, the at least one burr is produced in a form which includes a substantially uninterrupted flange projecting from the region of the casting.

In the production of a casting by the method in accordance with the invention, at least one core will almost invariably be employed in the casting mold, which core will be supported in one or more core-supporting holes formed in one or more of the mold sections. In such cases, the method according to the invention may comprise the further step of shaping at least one of the core and core-supporting holes so that, in a further region of the casting which solidifies where the core enters the core-supporting hole, a further burr is produced in a form which includes a further substantially uninterrupted flange projecting from the noted further region of the casting.

Using the method in accordance with the invention, a casting is produced with at least one substantially uninterrupted flange, preferably of substantially uniform thickness, projecting from the casting. The thickness of the or each flange is made as small as possible from the point of view of the casting technique employed and is, of course, dependent on the material and dimensions of the casting. For iron castings, the minimum thickness for an uninterrupted flange to be obtained with certainty is from about 2 mm to about 3 mm. A height of the flange of from about 5 mm to about 6 mm is generally suitable. The or each substantially uninterrupted flange is subsequently removed, preferably employing an industrial robot to effect relative movement between the flange(s) and a flange-removing means. Such a robot may be employed to move the flange-removing means along the flange(s) or to move the casting so that the flange(s) thereon is (are) brought into engagement with a flange-removing means.

The flange(s) may be removed either by a mechanical cutting tool, for example, a milling cutter or a power chisel, or by gas cutting. Many different types of gas cutting may be used. For the removal of the flange(s) from a casting of either alloyed or unalloyed steel, conventional gas cutting may be used with advantage. For these materials, and for castings of grey cast iron, nodular iron, annealed castings, stainless steel, and other heavy and light metals, iron powder cutting, arc air cutting, arc torch cutting, plasma cutting and laser cutting can be used for the removal of the flange(s). When removing the flange(s), well-defined working conditions are obtained for the flange-removing means, so that the finished casting has good, even surfaces where flange removal has been effected. This is important, particularly when using gas cutting methods where extinguishing of the flame is liable to occur if interruptions occur in the material being cut.

BRIEF DESCRIPTION OF THE DRAWINGS

The invention will now be described, by way of example, with reference to the accompanying drawings, wherein:

FIG. 1 is a side view of a cast valve housing, this view being taken in a direction perpendicular to the parting line of the mold in which the valve housing was cast, FIG. 2 is a sectional view taken on the line A—A of FIG. 1, FIG. 3 is a view, on an enlarged scale, of the encircled portion shown in FIG. 2.

DESCRIPTION OF PREFERRED EMBODIMENTS

Figure 4:
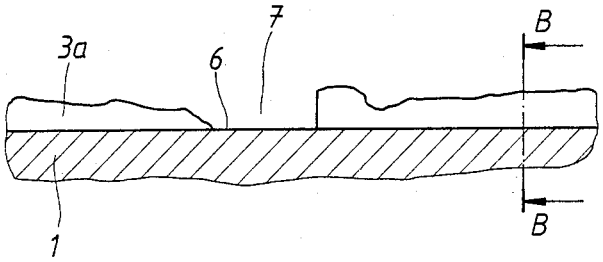
FIG. 4 is a sectional side view of part of an article which has been cast in a conventional manner.

In FIGS. 1 to 3, the numeral 1 designates a cast iron valve housing with three flanges 2 surrounding openings 5. This valve housing was cast in a two-section mold (not shown), the sections of which had such a shape, at the parting line of the mould, that a coherent flange 3, having a substantially uniform thickness of 2.5 mm and a height of 5 mm, was formed around the valve housing opposite the mold parting line. Furthermore, the shapes of the cores for producing the openings 5 in the flanges 2, and the shapes of the core-supporting holes, were such that a continuous flange, again having a substantially uniform thickness of 2.5 mm and a height of 5 mm, was formed around each of the openings 5 in the valve housing 1. Because of imperfect contact between the mould sections, a narrow gap of varying thickness between the mould sections along the mould parting line has resulted in the formation of a burr 3*a* (see FIG. 3) during casting, which burr is connected to the free edge of the flange 3. A similar burr (not shown) may also be formed along the free edge of the flanges 4, due to imperfect fit of the mold cores in their supporting holes.

Figure 5:
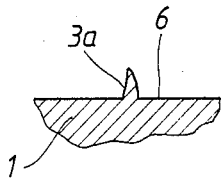
FIG. 5 is a sectional view taken on the line B—B of FIG. 4.
Figure 6:
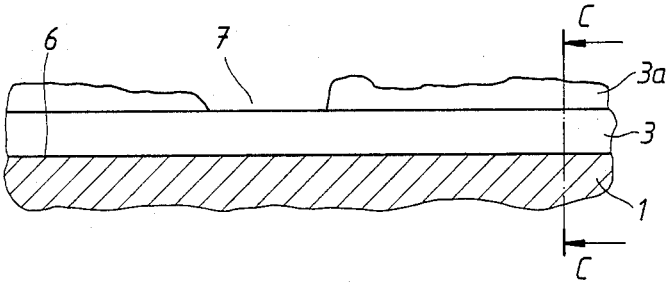
FIG. 6 is a sectional side view of part of an article cast in a manner proposed by the method in accordance with the present invention.
Figure 7:
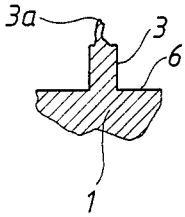
FIG. 7 is a sectional view taken on the line C—C of FIG. 6.

FIGS. 4 to 7 illustrate the difference between a conventionally produced casting and one produced in the manner proposed by the present invention. In the conventionally produced casting (FIGS. 4 and 5), the actual burr 3*a* projects directly from the surface 6 of the casting. This burr 3*a* is not continuous, but is interrupted by gaps 7. When de-burring a casting of such a design by conventional gas cutting methods, the flame may become extinguished due to the presence of the gaps 7. If an arc cutting method is used, the arc may be disturbed so that an uneven surface may be formed where the burr has been removed. Again, if mechanical de-burring is employed, the result of the burr removal may be influenced by the presence of the gaps 7.

In the casting produced in the manner proposed by the present invention (FIGS. 6 and 7) there is a continuous flange 3 which provides similar conditions at all places during removal of the flange, so that a uniform result is obtained. In this casting, any discontinuity 7 in the burr 3*a* on the free edge of the flange 3 has no effect on the result of the flange removal.

The actual flange removal may take place with the casting secured to a support, for example, a table, and continuously or intermittently moving the casting so that, at all times, the flange 3 (or 4) being removed is presented to the flange-removing means under the most favorable working conditions. Preferably, an industrial robot, suitably programmed, is employed to control the movements of the casting and/or the flange-removing means.

The invention is not, of course, limited to the precise embodiments of the method described above with reference to the drawings, and various modifications are feasible within the scope of the ensuing claims. Thus, for example, the casting mold employed may have more than two mold sections, and in this case the mold sections would be so shaped that more than one of the above-described, substantially uninterrupted flanges would be formed on the casting, each flange projecting from a region of the casting which solidifies opposite a respective one of the parting lines between adjacent mold sections.

What is claimed is:

1. In a method of producing a metal casting which comprises the steps of employing a casting mold having two mold sections contacting one another along a parting line, pouring a solidifiable melt into said mold, allowing the solidifiable melt to solidify into a metal casting, removing the solidified metal casting from said mold, said solidified casting including a first undesired burr thereon, and then removing said first undesired burr from said casting, the improvement wherein at least one of said mold sections is shaped in the vicinity of said parting line so that, in a first region of the casting that solidifies within said parting line, said first undesired burr is produced in a form which includes a first substantially uninterrupted flange projecting outwardly from said region of the casting, and wherein said step of removing said first undesired burr from said casting includes removing said first flange and thus said first undesired burr from said casting by employing an industrial robot to effect relative movement between said first flange and a flange-removing means.

2. A method according to claim 1, wherein said casting mold further comprises a core received in a core-supporting hole formed in one of said mold sections, said method comprising the further step of shaping at least one of said core and said core-supporting hole so that, in a second region of the metal casting within said casting mold which solidifies adjacent where said core enters said core-supporting hole, a second undesired burr is produced thereon in a form which includes a second substantially uninterrupted flange projecting outwardly from said second region of the casting, and wherein said second undesired burr is removed from said casting by said industrial robot effecting relative movement between said second substantially uninterrupted flange and a flange-removing means.

3. A method of producing a casting employing a casting mold having two mold sections in contact with one another along a parting line which during casting produce an undesired burr therebetween, comprising the steps of shaping at least one of said mold sections in the region of said parting line so that, on a casting produced in the mold, there is formed an undesired burr on a substantially uninterrupted flange of substantially uniform thickness which projects outwardly from the casting, pouring solidifiable melt into the casting mold to form therein a metal casting exhibiting said substantially uninterrupted flange, removing the solidified metal casting from said mold, and removing said undesired burr including said flange from the casting by employing an industrial robot to effect relative movement between said flange and a flange-removing means.

4. A method according to claim 1 or 3, wherein the flange-removing means employed is a mechanical cutting tool.

5. A method according to claim 1 or 3, wherein the flange-removing means employed is selected from the group consisting of gas cutting means, iron powder cutting means, arc air cutting means, arc torch cutting means, plasma cutting means and laser cutting means.

6. A method of producing a metal casting which will include a burr that can be removed, said method including the steps of (1) providing a casting mold comprising two mold sections which are contactable with one another along a parting line, at least one of said mold sections being shaped in the vicinity of said parting line such that with said mold sections in contact with one another and when a melt is poured therein and allowed to solidify, the metal casting formed therein will include a burr at said parting line, said burr including a substantially uninterrupted flange projecting outwardly from said casting, (2) contacting said two mold sections of said casting mold along their parting line, (3) pouring a solidifiable melt into said casting mold, (4) allowing said solidifiable melt to solidify, (5) removing the solidified casting from said mold, said solidified casting including a burr projecting therefrom adjacent the parting line of said two mold sections, said burr including a substantially uninterrupted flange, (6) placing said solidified casting on an arm of an industrial robot, and (7) causing said industrial robot to move said solidified casting relative to a flange-removing means to remove said substantially uninterrupted flange therefrom, and thus remove said burr therefrom.

7. A method of producing a metal casting which will include burr that can be removed, said method including the steps of (1) providing a casting mold comprising two mold sections which are contactable with one another along a parting line, at least one of said mold sections being shaped in the vicinity of said parting line such that with said mold sections in contact with one another and when a melt is poured therein and allowed to solidify, the metal casting formed therein will include a burr at said parting line, said burr including a substantially uninterrupted flange projecting outwardly from said casting, (2) contacting said two mold sections of said casting mold along their parting line, (3) pouring a solidifiable melt into said casting mold, (4) allowing said solidifiable melt to solidify, (5) removing the solidified casting from said mold, said solidified casting including a burr projecting therefrom adjacent the parting line of said two mold sections, said burr including a substantially uninterrupted flange, (6) placing said solidified casting on a support, and (7) causing an industrial robot which is carrying a flange-removing means to move relative to said solidified casting on said support such that the flange-removing means removes said flange therefrom, and thus remove said burr therefrom.

* * * * *